US009982978B2

(12) United States Patent
Teper et al.

(10) Patent No.: US 9,982,978 B2
(45) Date of Patent: May 29, 2018

(54) WARHEAD FOR GENERATING A BLAST ON AN EXTENDED REGION OF A TARGET SURFACE

(71) Applicant: RAFAEL ADVANCED DEFENSE SYSTEMS LTD., Haifa (IL)

(72) Inventors: Yosef Teper, Haifa (IL); Tal Nadav, Haifa (IL); Vitali Laos, Haifa (IL)

(73) Assignee: RAFAEL ADVANCED DEFENSE SYSTEMS LTD., Haifa (IL)

( * ) Notice: Subject to any disclaimer, the term of this patent is extended or adjusted under 35 U.S.C. 154(b) by 0 days. days.

(21) Appl. No.: 15/535,051

(22) PCT Filed: Nov. 15, 2015

(86) PCT No.: PCT/IL2015/051097
§ 371 (c)(1),
(2) Date: Jun. 11, 2017

(87) PCT Pub. No.: WO2016/098096
PCT Pub. Date: Jun. 23, 2016

(65) Prior Publication Data

US 2017/0343329 A1 Nov. 30, 2017

(30) Foreign Application Priority Data

Dec. 16, 2014 (IL) ..... 236306

(51) Int. Cl.

| | |
|---|---|
| ***F42B 10/00*** | (2006.01) |
| ***F42B 12/00*** | (2006.01) |
| ***F42B 30/00*** | (2006.01) |
| ***F42B 12/20*** | (2006.01) |

(52) U.S. Cl.
CPC ..... *F42B 12/207* (2013.01); *F42B 12/204* (2013.01)

(58) Field of Classification Search
CPC ..... F42B 12/207; F42B 12/204
USPC ..... 102/305, 314
See application file for complete search history.

(56) References Cited

U.S. PATENT DOCUMENTS

| | | | | | |
|---|---|---|---|---|---|
| 2,137,436 | A * | 11/1938 | Barnhart | F42B 12/204 | 102/394 |
| 3,820,463 | A * | 6/1974 | Leonard et al. | F42B 5/02 | 102/434 |
| 4,625,650 | A * | 12/1986 | Bilsbury | F42B 12/08 | 102/364 |
| 5,020,439 | A * | 6/1991 | Winter | F42B 12/204 | 102/473 |
| 5,542,354 | A * | 8/1996 | Sigler | F42B 12/204 | 102/473 |
| 5,852,256 | A * | 12/1998 | Hornig | F42B 12/204 | 102/473 |
| 6,871,594 | B1 * | 3/2005 | Estrella | F41H 9/10 | 102/368 |

(Continued)

*Primary Examiner* — Samir Abdosh
(74) *Attorney, Agent, or Firm* — Mark M. Friedman

(57) ABSTRACT

The present invention relates to warheads with blast wave conditioners and in particular to devices for quickly removing a door to permit entry through the doorway. It discloses a device and method of shaping the pressure wave pattern by the use of inert material. The inert material of the present invention is used to reduce localized directional effects occurring at the point of impact, instead generating a more diffuse pressure-wave pattern across the target surface.

16 Claims, 5 Drawing Sheets

(56) References Cited

U.S. PATENT DOCUMENTS

| | | | | |
|---|---|---|---|---|
| 7,886,668 | B2 * | 2/2011 | Hugus | C06B 21/005 102/473 |
| 9,243,876 | B1 * | 1/2016 | Botthof | F42B 12/22 |
| 2001/0007229 | A1 | 7/2001 | Dales | |
| 2007/0289475 | A1 | 12/2007 | Kapeles | |
| 2011/0174187 | A1 * | 7/2011 | Van Stratum | F42B 30/04 102/464 |
| 2011/0252995 | A1 * | 10/2011 | Dindl | F42B 10/48 102/376 |
| 2012/0085259 | A1 | 4/2012 | Cronemberger | |
| 2012/0216698 | A1 * | 8/2012 | Van Stratum | F42B 30/04 102/439 |
| 2013/0327571 | A1 | 12/2013 | Andrzejak | |
| 2014/0182473 | A1 * | 7/2014 | Dixon | F42B 12/52 102/363 |
| 2016/0025467 | A1 * | 1/2016 | Botthof | F42B 12/22 102/492 |
| 2016/0025468 | A1 * | 1/2016 | Botthof | F42B 1/02 102/475 |

* cited by examiner

| Design | Unconfined (prior art) | | | With powder buffer (new) |
|---|---|---|---|---|
| Stand-off (calibers) | 0 | 0.75 | 1.5 | 0 |
| $P_{MAX}$ (MPa) | 70 | 35 | 27 | 15 |
| V_door (m/sec) | 5.07 | 5.18 | 5.05 | 4.97 |

WARHEAD FOR GENERATING A BLAST ON AN EXTENDED REGION OF A TARGET SURFACE

FIELD AND BACKGROUND OF THE INVENTION

The present invention relates to warheads with blast wave conditioners and in particular to devices for quickly removing a door to permit entry through the doorway.

In various applications, particularly in military and law enforcement scenarios, it may be desired to quickly remove a door so as to gain access to a certain doorway which would otherwise be blocked by the presence of a locked door. For example, drug enforcement personnel frequently need to gain rapid entry into a dwelling during a drug raid. The entry must be performed quickly in order to prevent the occupants from hiding or destroying the drugs, from escaping the premises or from seizing arms and violently resisting the efforts of the authorities. Similarly, in various circumstances, police and/or military forces must be able to gain quick access to a house or other structure protected by a door, typically locked, in order to seize, preferably alive, one or more wanted persons inside the premises and/or to free innocent hostages held inside the structure. In all these cases access must be gained in such a way at to avoid injury to both the persons attempting to gain access and the persons located in the structure beyond the door to be removed.

Israel Patent No. 106629 teaches an entry system intended for such applications which is tired from a rifle with a bullet-trap arresting a standard bullet. The warhead has essentially of disk-shape with some curvature. Opening the door is achieved by the action of high pressure detonation products which impinge on its surface and displace it from its frame, without causing more than minimal damage to persons and property near and beyond the door. Further to the device of Israel Patent No. 106629, U.S. Pat. No. 6,408,765 by the same inventors and same assignees teaches a safety connector for the above device in order to eliminate a potential safety hazard, namely the possibility that the tail of the device be propelled rearwards at high velocity by the effect of the explosion, thereby injuring personnel. The safety connector being configured to reduce shock forces acting on the tail resulting from detonation of the explosive charge. This device is illustrated in FIG. 1.

The device as taught by Israel Patent 106629 and U.S. Pat. No. 6,480,765 is effective and safe and has been fielded by the US Army under the name of GREM. There is however a desire to achieve the same effect with a device of smaller dimensions, such as for example compatible with the M203 40 mm grenade launcher. For the specific application of a door breaching grenade of this caliber, the device would preferably satisfy the following conditions:

1. Delivering sufficient pressure impulse to open the door.
2. Avoid breaking through the door in order to minimize fragment and pressure damage to persons within the room.
3. Avoid hazards to gunner that could arise from both from fragments projected from the rear part of the charge or ricochets from the door.
4. Provide sufficient effect versus heavy steel doors without causing excessive damage to light (e.g., wooden) doors.

A grenade with an essentially unconfined charge will generate a spherical blast wave pattern. As a result, the highest pressure is obtained along the main axis and will result in excessive peak pressure at the impact point.

Depending on the type of door, and in particular for thin doors, such peak pressure might generate excessive damage. In order to mitigate such damage, a stand-off device is provided in U.S. Pat. Nos. 8,413,586 and 8,468,946, as illustrated in FIG. 2. Such stand-off extension device involves extra weight and complexity.

SUMMARY OF THE INVENTION

The present invention is a warhead for generating a distributed blast effect on a surface.

By way of introduction, a blast warhead typically generates a generally spherical blast wave pattern. The present invention discloses a device and method of shaping the pressure wave pattern by the use of inert material. Unlike conventional shaped-charge and fragmentation warheads in which wave shapers are sometimes used to enhance directional jetting and fragmentation patterns, the inert material of the present invention is used to reduce localized directional effects occurring at the point of impact, instead generating a more diffuse pressure-wave pattern across the target surface.

In one preferred implementation, the warhead is implemented with a generally cylindrical shape explosive charge with an inert dome as confinement on at least the leading end, and preferably both ends. As a result, a generally annular or "doughnut-shaped" blast wave pattern is generated around the warhead, rather than the near-spherical shape that would be generated in the absence of such confinement.

An application of particular interest for this type of warhead is door-breaching. As a matter of substance and of terminology, it should be noted that the device of the present invention is intended to enable entry by opening or removing a door rather than breaking through the door. A blast sufficiently focused to break through a door may cause substantial damage to property and injury to persons within the structure without in fact actually enabling entry. In view of this distinction, any use of the term "door breaching" herein in the description and claims is used to refer to a scenario of removing a door from a doorway, with or without its door frame. It should also be noted that the invention is not limited to door breaching scenarios, and can also be used to advantage in any case where it is desired to apply a diffuse blast over a relatively large surface area of a target.

In certain implementations, the warheads of the present invention obviate the need for a standoff extension device, instead allowing the warhead to be detonated on direct impact against the target surface, with only a moderate peak pressure at the point of impact.

Thus, according to the teachings of the present invention there is provided, a warhead comprising: (a) an explosive charge having a direction of elongation and a convex front surface; and (b) a non-fragment-forming blast-shaping arrangement comprising a quantity of powder deployed to cover a majority of the convex front surface.

According to a further feature of an embodiment of the present invention, the powder is a metal powder.

According to a further feature of an embodiment of the present invention, the metal powder is selected from the group consisting of: tungsten; molybdenum; and metal alloys including at least one of tungsten and molybdenum.

According to a further feature of an embodiment of the present invention, the metal powder is dispersed in a polymer binder.

According to a further feature of an embodiment of the present invention, the powder is deployed to cover at least 90 percent of the convex front surface.

According to a further feature of an embodiment of the present invention, a rear surface of the explosive charge has a convex surface, the warhead further comprising a non-fragment-forming rear confinement covering a majority of a rear surface of the explosive charge.

According to a further feature of an embodiment of the present invention, there is also provided a fuze configured to detonate the explosive charge on impact of the warhead against a target.

There is also provided according to the teachings of an embodiment of the present invention, a projectile comprising: (a) a projectile body; and (b) the aforementioned warhead disposed within the projectile body.

According to a further feature of an embodiment of the present invention, the projectile is a 40 mm grenade.

According to a further feature of an embodiment of the present invention, the projectile is unguided.

According to a further feature of an embodiment of the present invention, the projectile further comprises a guidance system.

According to a further feature of an embodiment of the present invention, the projectile further comprises a rocket motor deployed for propelling the projectile.

According to a further feature of an embodiment of the present invention, the projectile is configured for use without any standoff extension.

There is also provided according to the teachings of an embodiment of the present invention, a method comprising the steps of: (a) obtaining the aforementioned warhead; and (b) detonating the warhead in contact with a door in order to remove the door.

According to a further feature of an embodiment of the present invention, the warhead is incorporated into a projectile which is fired at the door.

According to a further feature of an embodiment of the present invention, the projectile is a 40 millimeter grenade fired from a grenade launcher.

BRIEF DESCRIPTION OF THE DRAWINGS

The invention is herein described, by way of example only, with reference to the accompanying drawings, wherein.

DESCRIPTION OF THE PREFERRED EMBODIMENTS

Figure 1:
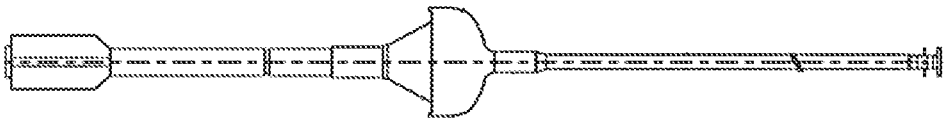
FIG. 1 (PRIOR ART)
FIG. 1 is a schematic illustration of a door-breaching ammunition according to the teachings of U.S. Pat. No. 6,408,765.
Figure 2:
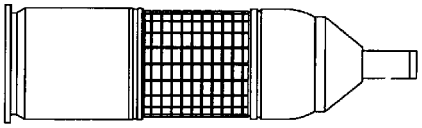
FIG. 2 (PRIOR ART)
FIG. 2 is a schematic illustration of a door-breaching grenade with a stand-off rod according to the teachings of U.S. Pat. No. 8,468,946.

The present invention is a warhead for generating a distributed blast effect on a surface, and munitions employing such a warhead.

The principles and operation of warheads and munitions according to the present invention may be better understood with reference to the drawings and the accompanying description.

Referring now to the drawings, FIGS. 3-8 illustrate various aspects of the structure and function of a warhead, generally designated 100, constructed and operative according to an embodiment of the present invention.

Generally speaking, warhead 100 includes an explosive charge 120 having a direction of elongation 122 and a convex front surface 124. A non-fragment-forming blast-shaping arrangement 140, including a quantity of powder, is deployed to cover a majority of convex front surface 124. The powder is preferably an inert metal powder, and is preferably densely dispersed in a polymer binder.

Figure 4:
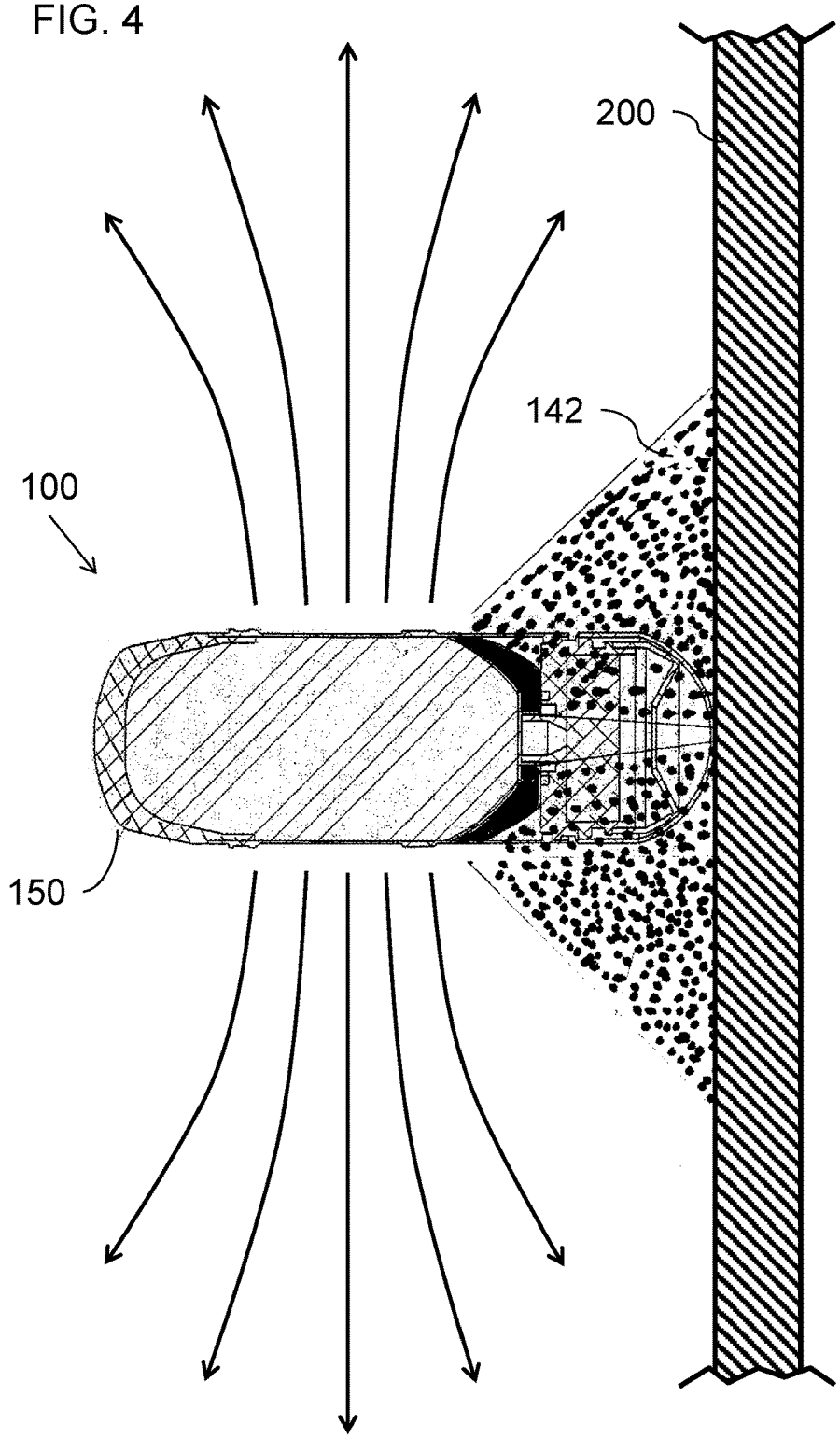
FIG. 4 is a schematic representation of the distributed blast effect of the warhead of FIG. 3 impinging on a surface.
Figures 5, 6:
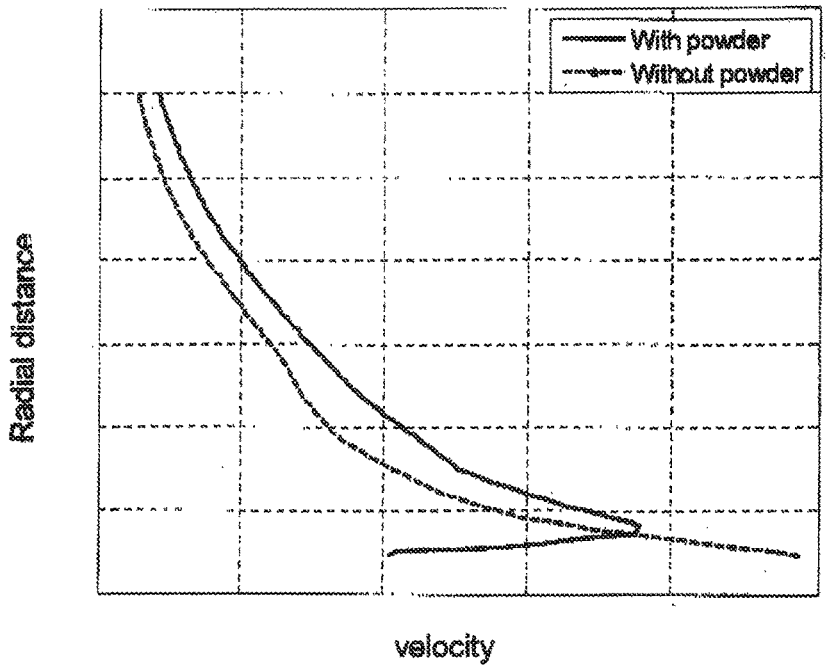
FIG. 5 is a table providing comparative calculated values for the blast effect of a conventional 40 millimeter grenade impinging on a surface with various different lengths of stand-off rod compared to the present invention.
FIG. 6 is a graph illustrating the propagation velocity of detonation products ("blast") towards the surface as a function of radial distance from the point of impact.

The effect of non-fragment-forming blast-shaping arrangement 140 is illustrated schematically in FIG. 4, and further detailed in FIGS. 5 and 6. Referring first to FIG. 4, when the warhead impinges on a surface, such as a door 200, explosive charge 120 is detonated. The presence of the mass of powder adjacent to the front surface of the explosive charge provides inertial resistance to propagation of the blast wave in the forward axial direction. As a result, a part of the blast wave that would have propagated forwards is redirected radially outwards, contributing to an enhanced annular blast wave distribution which is believed to reach peak values at the target surface more than one caliber away from the central axis of the warhead at the moment of initiation.

While diverting the blast wave as described, part of the momentum of gaseous detonation products is transferred to the compacted inert powder mass which is thereby accelerated and spreads in a diverging conical pattern 142 with a cross-section that increases in the axial direction. This results in a diverging shower of powder particles against a region of the surface around the point of impact. The powder particles are too small to have significant penetrating effect, and have much lower velocity that the unrestricted laterally-directed blast wave. As a result, the powder is effective to transfer an impulse to surface 200 without the localized axial pressure spike which might otherwise lead to penetration through a door.

FIG. 5 presents a table illustrating the effect of the use of blast-shaping arrangement 140 compared to the conventional approach of increasing the stand-off distance at which the warhead is detonated. For the purpose of this description and the appended claims, "zero standoff" is defined as a design in which detonation of the warhead occurs on contact of the front end of the casing with the target surface without provision of any dedicated structure designed to extend the forward part of the casing beyond what is necessary to house the required internal components. The normal structure of a warhead typically includes a fuze arrangement including an impact sensor, a safe-and-arm mechanism, a detonation train and a booster pellet, all contributing to a certain built-in spacing between the front of the explosive charge and the nose of the casing in the "zero standoff" case. This built-in spacing typically corresponds to about one "caliber" (i.e., the outer diameter of the body of the warhead casing).

As seen in the middle three columns, the peak pressure along the axis of a conventional 40 millimeter grenade warhead drops off as the stand-off increases, which for door breaching applications corresponds to a reduced risk of localized penetration through the door. The right column shows the comparative values for a 40 millimeter grenade including a blast-shaping arrangement according to the present invention. The weight of the explosive charge and the weight of the aft confinement is the same in both cases. The inventive design includes in addition a front confinement which is an inert powder buffer with a preferred weight in the range of 25%-45% of the explosive weight. It can be seen that that in case of the inventive charge, the inert buffer effectively mitigates the peak pressure $P_{MAX}$ as compared to an unconfined charge. It can be seen that such mitigation is even more effective than increasing the stand-off. The table also presents a comparison of the calculated values of the velocity to which a breached door (of a given type and weight) is accelerated. As it can be seen, this parameter does not vary significantly with the changes in the stand-off within the evaluated range, because they are small relative to the transverse dimensions of the typical door. Although the inert buffer charge absorbs part of the explosive energy directed onto the door, this effect occurs only nearby the impact point (affecting maximum pressure PMAX: and not over most of the door area which experiences essentially the same overall pressure field as the unconfined design.

The calculated velocity pattern of the blast reaching the surface is illustrated in FIG. 6 as a function of radial distance from the axis of the charge. As described above, the blast-shaping arrangement 140 is effective to divert laterally a part of the blast which would otherwise have advanced axially towards the target surface. This greatly reduces the velocity peak near the axis of the warhead, instead resulting in an annular pattern of velocity with a peak typically occurring at a radial distance of 1-2 calibers from the axis of the warhead. This contrasts clearly with the dashed curve which illustrates the velocity distribution in the absence of a blast-shaping arrangement according to the teachings of the present invention. In the latter case, the velocity of the blast towards the surface increases dramatically towards the axis of the warhead.

Thus, the overall effect of an aspect of the invention is that the blast wave along the center axis is at least partially "blocked" by the confinement of the blast-shaping arrangement, and the pressure peak on the door along the charge centerline is avoided or greatly reduced. Instead of being focused at the center, the pressure is spread out across the door surface by the powder which in fact serves as a buffer.

Turning now to features of an embodiment of the present invention in more detail, as mentioned above, the powder of blast-shaping arrangement 140 is preferably a metal powder, and most preferably a heavy metal (i.e., with density above 7 grams per cubic centimeter, and more preferably about 9 grams per cubic centimeter). Particularly preferred examples include, but are not limited to, tungsten, molybdenum and alloys rich in one or both of tungsten and molybdenum. The particularly high density of tungsten makes it a most preferred option, allowing for use of a relatively smaller volume of powder to achieve a desired result compared to metals of a lower density. The material is chosen to be "inert", here meaning that it does not play a significant role in the chemical reaction of the explosive charge, and does not conglomerate into larger fragments. The powder preferably has a particle size in the range of 25-250 microns.

The heavy metal powder may constitute a disperse phase within a low-density, low mass-fraction binder, which serves to mechanically stabilize the powder. The binder is typically a polymer binder, such as, for example, rubber.

As mentioned previously, the powder of blast-shaping arrangement 140 is deployed to cover the majority of front surface 124. Most preferably, at least 90 percent of convex front surface 124 is covered by the powder. In this context, the proportion of the surface covered is preferably defined as the proportion of the circular area of the explosive charge as viewed in an axial projection, in the example illustrated here, a central opening through blast-shaping arrangement 140 is left to accommodate the ignition components (described further below). However, in the case of electronic ignition, this opening also can be eliminated or reduced to negligible dimensions, thereby allowing the blast-shaping arrangement to cover substantially the entirety of convex front surface 124.

As mentioned, front surface 124 is convex. The term "convex" is used herein to exclude concave "hollow-charge" type structures and full-width flat-ended cylindrical charges, both of which inherently tend to generate a highly directional forward-directed component to the blast distribution. It should be noted however that the term "convex" does not exclude structures in which the charge has various flat facets, so long as the overall shape of the front end of the charge is generally convex.

Figure 3:
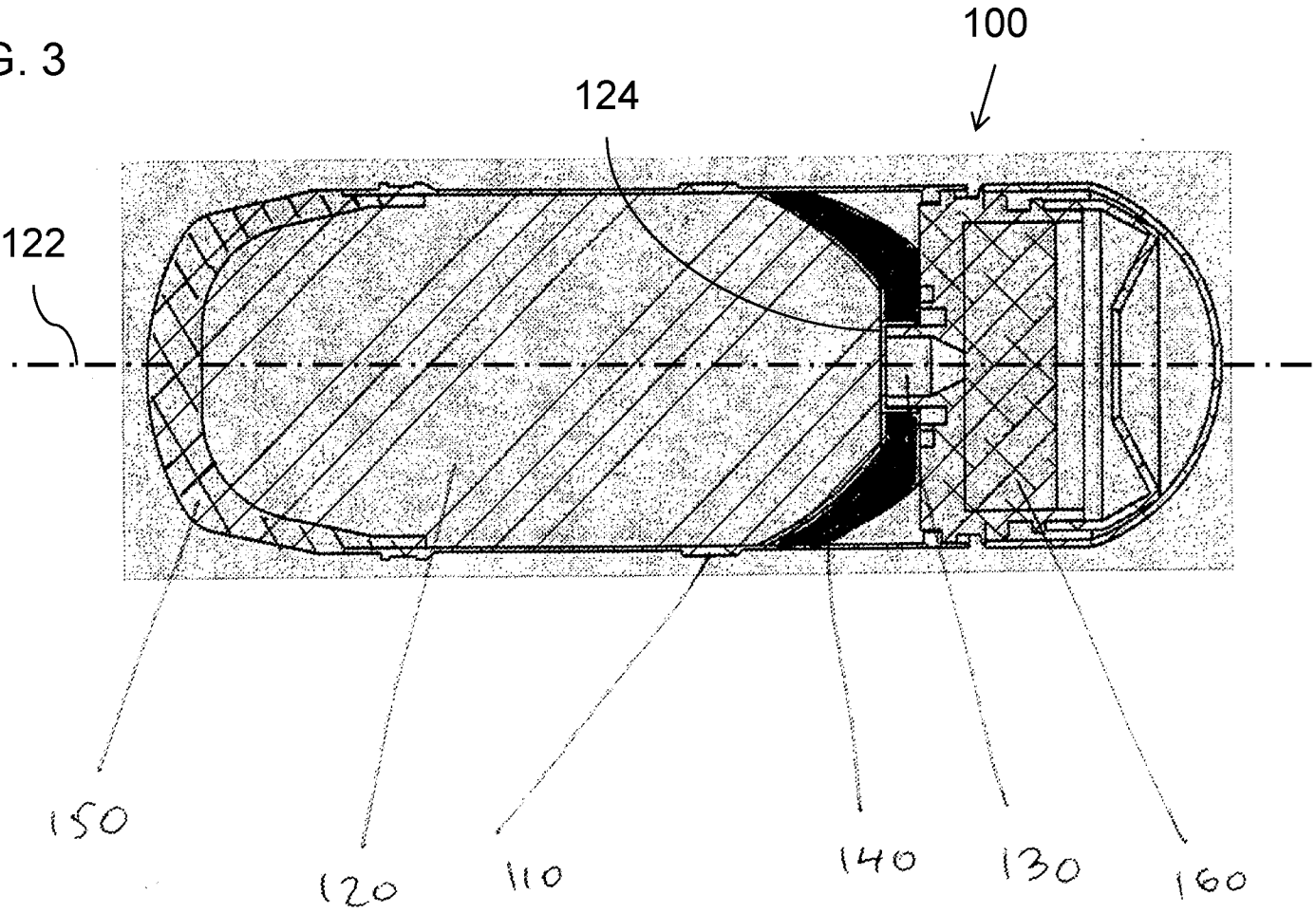
FIG. 3 is a cross-sectional view taken through a warhead constructed and operative according to the teachings of an embodiment of the present invention.

As one particularly advantageous but non-limiting example, the embodiment of the invention illustrated here in FIGS. 3 and 4 is implemented as a standard 40 millimeter grenade, integrated with a suitable for integration into a cartridge for firing from a standard 40 mm grenade launcher (not shown). The grenade as illustrated here is shown with a warhead casing 110 and a rear confinement 150, which has a standard form for integration into such a round. The rear confinement 150 serves as a non-fragment-forming rear buffer covering a majority of a convex rear surface of explosive charge 120. Most preferably, a lightweight polymer material is used for rear confinement 150. Casing 110 is typically also formed from a light material, such as aluminum, and is considered to have minimal effect on the distribution of the detonation products of the explosive charge.

Warhead 100 preferably also includes a fuze configured to detonate the explosive charge on impact of the warhead against a target. Typically, a detonation train pyrotechnically connects between output of a safe-and-arm (S&A) device 160 and a booster pellet 130.

As depicted in FIGS. 3 and 4, S&A device 160 is mounted at the front end of explosive charge 120. In this case, any risk of hazard to the gunner is eliminated due to fragments originating from the S&A device is avoided. In an alternative implementation (not shown), S&A device 160 is located at the aft side of the projectile. In this case, design features, materials and dimensions of the S&A are chosen to ensure its disintegration into fragments that are harmless at the relevant safety distance. Even in the front-mounted S&A option, the design is chosen such that any fragments generated will be small and light enough to avoid danger of penetrating the target. In particular, a MEMS S&A, such as taught by example in U.S. Pat. No. 8,522,682, is suitable for such implementations. In general, S&A device 160 includes, or is connected to, a target sensing device, which may be mechanical device (such as a striker) or an electronic device (such as an impact switch or proximity sensor). In case that an electronic device is implemented as target sensing device, the grenade will be further provided with an adequate power supply.

During storage and during tactical usage prior to launch, the S&A device is in "SAFE" condition. After firing the grenade, and once the predefined arming conditions are met, the S&A device will shift into "ARMED" condition. Upon sensing the target, the detonation chain is initiated and as a result, the explosive charge detonates. The blast wave generated by the detonation and conditioned by the inert powder mass impinges on the target door and removes it without breaking it or projecting fragments behind it.

Although it is believed that certain embodiments of the present invention avoid the need for an extended stand-off distance between the warhead and the target, it should be noted that the invention is applicable to a wide range of applications and types of target, and that applications in which it is considered advantageous to install a stand-off rod on the front side of the grenade also fall within the scope of the present invention.

It should be noted that, while the invention has been illustrated thus far in the context of an embodiment as a warhead incorporated in a 40 mm grenade, the warhead of the present invention may be used in a wide range of applications, including manual deployment against a target and including incorporation into other projectiles including, but not limited to, unguided rockets and guided missiles. In certain applications, the warhead may be scaled-up to any desired dimensions, all according to the intended application and the desired effect.

Figure 7:
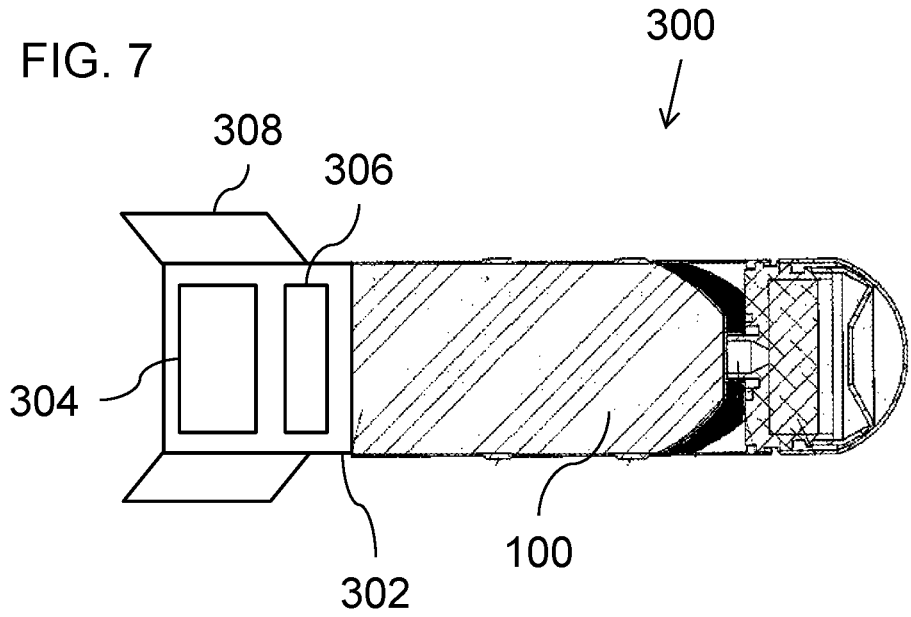
FIG. 7 is a schematic representation of an alternative implementation of the present invention as a guided missile.

By way of one non-limiting example, FIG. 7 illustrates an implementation of the present invention as a guided missile 300 in which warhead 100 is housed in a missile body 302 which also includes a rocket motor 304 and a missile guidance system 306 controlling steerable aerodynamic control surfaces 308. It will be appreciated that the various features of missile 300 other than the warhead design do not per se constitute part of the present invention, and will therefore not be described here in detail. Structure and operation of warhead 100 for each application is similar to that described above, with the possible exception of details of the rear end of the warhead which are typically less critical for longer distance applications where there is less concern of damage due to rearwardly ejected debris.

It will be appreciated that the above descriptions are intended only to serve as examples, and that many other embodiments are possible within the scope of the present invention as defined in the appended claims.

What is claimed is:

1. A warhead comprising:

(a) an explosive charge having a direction of elongation and a convex front surface; and (b) a non-fragment-forming blast-shaping arrangement comprising a quantity of inert powder deployed to cover a majority of said convex front surface.

2. The warhead of claim 1, wherein said powder is a metal powder.

3. The warhead of claim 2, wherein said metal powder is selected from the group consisting of: tungsten; molybdenum; and metal alloys including at least one of tungsten and molybdenum.

4. The warhead of claim 2, wherein said metal powder is dispersed in a polymer binder.

5. The warhead of claim 1, wherein said powder is deployed to cover at least 90 percent of said convex front surface.

6. The warhead of claim 1, wherein a rear surface of said explosive charge has a convex surface, the warhead further comprising a non-fragment-forming rear confinement covering a majority of a rear surface of said explosive charge.

7. The warhead of claim 1, further comprising a fuze configured to detonate said explosive charge on impact of the warhead against a target.

8. A projectile comprising:

(a) a projectile body; and (b) the warhead of claim 1 disposed within said projectile body.

9. The projectile of claim 8, wherein said projectile is a 40 mm grenade.

10. The projectile of claim 8, wherein said projectile is unguided.

11. The projectile of claim 8, wherein said projectile further comprises a guidance system.

12. The projectile of claim 11, wherein said projectile further comprises a rocket motor deployed for propelling the projectile.

13. The projectile of claim 8, wherein said projectile is configured for use without any standoff extension.

14. A method comprising the steps of:

(a) obtaining a warhead according to claim 1; and (b) detonating the warhead in contact with a door in order to remove the door.

15. The method of claim 14, wherein said warhead is incorporated into a projectile which is fired at the door.

16. The method of claim 15, wherein said projectile is a 40 millimeter grenade fired from a grenade launcher.

* * * * *